US007963464B2

(12) United States Patent
Lewis et al.

(10) Patent No.: US 7,963,464 B2
(45) Date of Patent: Jun. 21, 2011

(54) FUEL INJECTOR AND METHOD OF ASSEMBLY THEREFOR

(75) Inventors: Stephen R. Lewis, Chillicothe, IL (US); Shriprasad Lakhapati, Peoria, IL (US); Christopher D. Hanson, Washington, IL (US); Avinash Manubolu, Edwards, IL (US); Daniel R. Ibrahim, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 428 days.

(21) Appl. No.: 12/018,322

(22) Filed: Jan. 23, 2008

(65) Prior Publication Data

US 2009/0184185 A1 Jul. 23, 2009

(51) Int. Cl.

| | |
|---|---|
| ***F02M 47/02*** | (2006.01) |
| ***F02M 61/10*** | (2006.01) |
| ***F02M 61/20*** | (2006.01) |
| *F02M 51/06* | (2006.01) |
| *F02M 51/00* | (2006.01) |

(52) U.S. Cl. ..... 239/533.8; 239/88; 239/89; 239/96; 239/533.9; 239/533.11

(58) Field of Classification Search ..... 239/88–92, 239/96, 533.2, 533.3, 533.8, 533.9, 533.11, 239/585.1–585.5; 123/472

See application file for complete search history.

(56) References Cited

U.S. PATENT DOCUMENTS

| | | | | |
|---|---|---|---|---|
| 5,381,772 | A | 1/1995 | Melchior et al. | |
| 5,752,486 | A | 5/1998 | Nakashima et al. | |
| 6,027,037 | A | 2/2000 | Murakami et al. | |
| 6,098,598 | A | 8/2000 | Riefenstahl et al. | |
| 6,152,109 | A | 11/2000 | Melchior | |
| 6,293,254 | B1 | 9/2001 | Crofts et al. | |
| 6,499,669 | B2 | 12/2002 | Ganser | |
| 6,705,551 | B1 | 3/2004 | Kienzler et al. | |
| 6,837,221 | B2 | 1/2005 | Crofts et al. | |
| 6,907,863 | B2 | 6/2005 | Henmi | |
| 6,908,049 | B2 | 6/2005 | Deluca | |
| 6,928,985 | B2 | 8/2005 | Boecking | |
| 7,159,799 | B2 | 1/2007 | Cooke | |
| 7,159,800 | B2 | 1/2007 | Peterson, Jr. | |
| 7,219,656 | B2 | 5/2007 | Ricco et al. | |
| 7,243,862 | B2 | 7/2007 | Dingle | |
| 7,249,722 | B2 | 7/2007 | Cibotti | |
| 2004/0007210 | A1 * | 1/2004 | Tian et al. | 123/456 |

OTHER PUBLICATIONS

Blessing et al. "Analysis of flow and cavitation phenomena in diesel injection nozzles and its effects on spray and mixture formation." SAE Transactions 112 (2003), url:<http://cat.inist.fr/?aModele=afficheN&cpsidt=16124886> downloaded Mar. 16, 2009, abstract.

* cited by examiner

*Primary Examiner* — Darren W Gorman

(74) *Attorney, Agent, or Firm* — Leydig, Voit & Mayer

(57) ABSTRACT

A fuel injector and a method of assembly includes a determination of various flow areas through clearances or openings formed in various components of the injector. With the various flow areas determined, the various components can be classified according to their flow areas such that sets of components can be selected having desirable flow area characteristics for assembly of the fuel injector.

4 Claims, 4 Drawing Sheets

FUEL INJECTOR AND METHOD OF ASSEMBLY THEREFOR

TECHNICAL FIELD

This patent disclosure generally relates to fuel injectors for internal combustion engines and, more particularly, to fuel injectors used with high-pressure common-rail fuel systems.

BACKGROUND

Fuel injectors operate to inject controlled amounts of fuel into a combustion chamber of an internal combustion engine. Typical fuel injectors include a body or housing containing one or more actuators arranged to operate valves that route fuel at a high pressure out of the injector and into the engine. More specifically, a typical injector housing forms a needle chamber positioned at a distal end of the injector and terminates at a "nozzle." For direct injection engines, the nozzle generally projects at least partially into the combustion chamber of the engine. The nozzle forms a plurality of nozzle openings configured for injecting or spraying pressurized fuel from the needle chamber into the combustion chamber.

Flow of fuel through the nozzle openings is controlled with a needle or check valve positioned for reciprocating movement within the needle chamber. A typical needle valve can be selectively actuated to supply fuel from the needle chamber at desired times and for desired durations. The timing of injection events or needle valve actuations may depend on factors such as the operating speed of the engine. The duration of each injection often depends, at least in part, on the amount of fuel desired per combustion stroke of the engine or, stated differently, on the power output of the engine.

With more stringent emissions and fuel consumption requirements, fuel injectors are required to operate at higher injection pressures and with greater precision.

SUMMARY

A fuel injector and a method of assembly therefor is disclosed. The method includes determining various flow areas present in clearances or openings formed in components of the injector. The injector components are classified based on their respective flow areas such that sets of components can be selected having desirable flow area characteristics for assembly of the fuel injector. Accordingly, the embodiments of fuel injectors disclosed herein feature the various control clearances and orifices affecting performance formed on separate components to facilitate separable classification for the various components.

The disclosure describes, in one aspect, a method for assembling a fuel injector. Initially, a clearance flow area of an assembly including a needle disposed within a needle guide is determined, and the assembly is categorized based on the clearance flow area. Further, an orifice flow area of a plate having an orifice formed therein is determined, and the plate is also categorized based on the orifice flow area. An assembly is selected based on its flow area to cooperate with the orifice flow area of a plate and yield a matched set of components. The respective flow areas of each matched set are selected such that a ratio of the clearance area to the orifice flow area is within a predetermined range. Thereafter, a fuel injector is built using the matched set.

In another aspect, the disclosure describes a fuel injector including a housing having a three-port two-position (3-2) valve. The 3-2 valve has a first port fluidly connected to a second port when the valve is in a first position, and a third port fluidly connected to the first port when the valve is in a second position. A needle guide forms a guide opening accepting a guide portion of the needle with a clearance defined therebetween. A second plate forms a bore opening located adjacent to the needle guide such that the bore opening is aligned with the guide opening. A first plate forms a first orifice in fluid communication with the first port of the 3-2 valve. The first plate is stacked on the second plate and surrounds a control chamber wetting a closing hydraulic surface of the needle. The control chamber extends between the closing hydraulic surface, the bore opening in the second plate, and the first plate, such that the control chamber is fluidly accessible through the first orifice and the clearance.

DETAILED DESCRIPTION

The present disclosure relates to fuel injectors for use on internal combustion engines. Internal combustion engines include a plurality of combustion cylinders including reciprocating pistons. The reciprocating pistons cyclically compress a mixture of air and fuel, which combusts yielding power that pushes each piston during an expansion stroke. The piston is subsequently pushed back into the combustion cylinder during a contraction stroke, and the process repeats during operation of the engine. This reciprocal motion of the pistons, which are connected via connecting rods to a crankshaft, is transformed to rotational motion of the crankshaft. Modern engines have fuel injectors injecting fuel directly into each combustion cylinder at predetermined times during operation of the engine. Such engines may also include a fuel delivery and/or pressurization system that provides pressurized fuel to each injector. Typically, each combustion cylinder of the engine is associated with a respective fuel injector that is arranged to inject fuel into the combustion cylinder.

The various embodiments of fuel injectors described herein are described in the context of fuel injectors for use with a high pressure common rail (HPCR) fuel system but, as can be appreciated, the apparatus and methods described have broad applicability in any other types of fuel injectors. For example, the disclosed fuel injector may be employed in hybrid fuel systems using an actuation fluid, fuel, or oil to intensify the injection pressure of the fuel being injected. The embodiments described herein are illustrative and should not be construed as limiting.

Figures 1, 2:
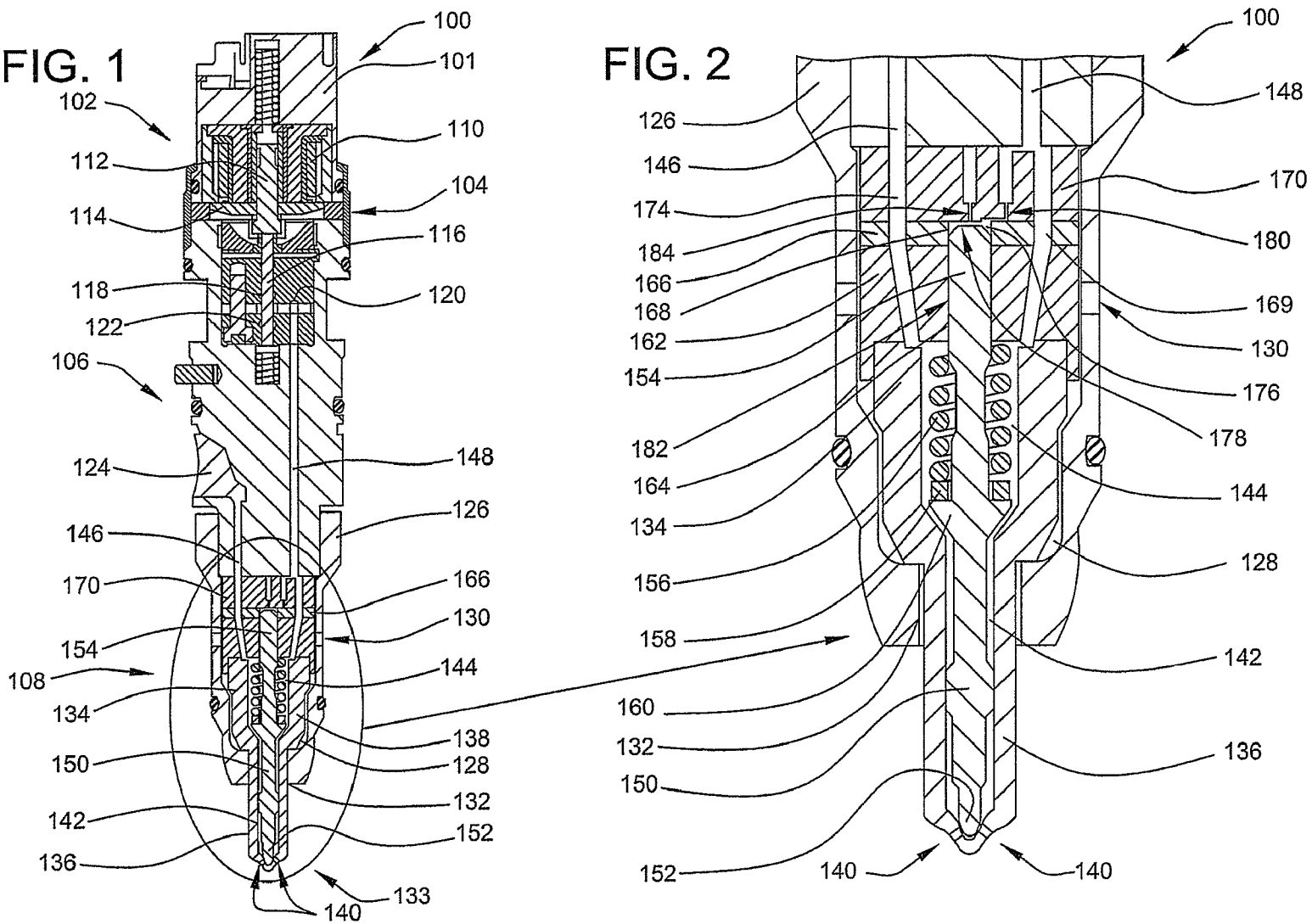
FIG. 1 is a cross section of a fuel injector in accordance with a first embodiment of the disclosure.
FIG. 2 is a detail cross section of the fuel injector shown in FIG. 1.

FIG. 1 shows a cross section of a first embodiment for a fuel injector 100. A more detailed cross section of the fuel injector 100 is shown in FIG. 2. The injector 100 includes, in general, a housing or control portion 102 including a three-way two-position (3-2) valve 104, an extension portion 106, and an injection portion 108. The control portion 102 is shown positioned close to a top or first distal end 101 of the injector 100. Electrical connectors (not shown) may transfer electrical control signals to an actuator or solenoid 110 operating a core 112 connected to a poppet 114. A poppet rod 116 and the core 112 are arranged to move in an axial direction when the solenoid 110 is energized. The poppet rod 116, operating in conjunction with the poppet 114, enables action of the 3-2 valve 104 to fluidly connect a first port 118 with a second port 120 when the core 112 is in a first or deactivated position, as shown in FIG. 2. The poppet rod 116 and poppet 114 operate to fluidly connect the first port 118 with a third port 122 by moving the core 112 to a second or activated position.

The extension portion 106 includes a pressurized fuel inlet interface 124 arranged for connection with a conduit (not shown) connected to a common rail or reservoir (not shown) containing fuel at a high or supply pressure during operation. The injection portion 108 includes a cone nut 126 threadably connected with the extension portion 106 to form an internal drain gallery 128. One or more drain openings 130 (two shown) formed in the cone nut 126 are arranged to route fuel at a low or return pressure out of the injector 100 to a fuel reservoir (not shown). The drain openings 130 are fluidly connected to the third port 122 of the 3-2 valve 104 via drain passages (not shown) formed in the extension portion 106.

The cone nut 126 also forms a nozzle opening 132 at its distal end. A generally cylindrical needle housing 134 forms a nozzle portion 136 extending from the nozzle opening 132 to define a second distal end 133 of the injector 100. A spring chamber portion 138 of the needle housing 134 is located within the internal drain gallery 128 of the cone nut 126. The nozzle 136 forms a plurality of nozzle openings 140 arranged to inject fuel into a combustion chamber of an engine (not shown) during operation.

Fuel injected from the nozzle openings 140 is at or close to the supply pressure during operation and occupies a needle chamber 142 defined internal to the nozzle portion 136. A spring chamber 144 is defined within the spring chamber portion 138 and is in fluid communication with the needle chamber 142. The needle chamber 142 and the spring chamber 138 are in direct fluid communication with the fuel inlet interface 124 via a supply pressure passage 146. The spring chamber 144 is also in fluid communication with a longitudinal supply pressure passage 148 extending between the spring chamber 138, through the extension portion 106, and to the second port 120 of the 3-2 valve 104.

A needle 150 having a valve seat portion 152 and a guide portion 154 is housed, at least partially, within the needle housing 134. The valve seat portion 152 of the needle 150 contacts the nozzle portion 136 of the needle housing 134 such that the nozzle openings 140 are fluidly blocked from the needle chamber 142 when the needle 150 is in the closed or deactivated position. A spring 156 and backing ring 158 are positioned within the spring chamber 144 surrounding a segment of the guide portion 154 of the needle 150. The spring 156 may be partially compressed between a ledge 160 formed on the needle 150 and a needle guide or needle guide block 162 abutting the needle housing 134 within the cone nut 126 when the needle 150 is in the closed position. The needle guide block 162 forms a longitudinal guide opening 164 surrounding and sealingly but slideably engaging the guide portion 154 of the needle 150.

A second or spacer plate 166 forming a bore 168 extending therethrough is stacked over the guide block 162 such that the bore 168 is aligned with the longitudinal guide opening 164. As can be appreciated, the spacer plate 166 forms two additional passage openings 169, which partially define each of the supply pressure passages 146 and 148. A first or orifice plate 170 is stacked over the spacer plate 166 within the cone nut 126. The orifice plate 170 also forms two passage openings 174 partially defining each of the supply pressure passages 146 and 148.

A control chamber 176 is laterally defined within the bore 168 of the spacer plate 166. The control chamber 176 extends axially between the orifice plate 170 and a closing hydraulic surface 178 defined on a distal end of the needle 150 opposite the valve seat portion 152 thereof. The volume of the control chamber 176 varies as the needle 150 moves longitudinally within the needle housing 134. The control chamber 176 fluidly communicates with the needle chamber 142 via a second or supply pressure opening or orifice 180 formed in the orifice plate 170. The second orifice 180 fluidly connects the control chamber 176 with a source of fuel at the supply pressure, in this case, the longitudinal supply pressure passage 148. During operation, the control chamber 176 is disposed to accept fuel at the supply pressure via the second orifice 180. In some embodiments, a clearance 182 defined between the guide portion 154 of the needle 150 and the guide opening 164 of the needle guide block 162 may also supply fuel at the supply pressure to the control chamber 176, for instance, from the needle chamber 142. The clearance 182 may further extend between the guide portion 154 of the needle 150 and the bore 168 of the spacer plate 166 to provide a flow path for fluid passing therebetween into the control chamber 176.

A first or return pressure opening or orifice 184 is formed in the orifice plate 170 and arranged to fluidly connect the first port 118 of the 3-2 valve 104 with the control chamber 176 via a communication passage (not shown) extending through the extension portion 106. The first orifice 184, via action of the 3-2 valve 104, is arranged to supply fuel at the supply pressure to the control chamber 176 when the 3-2 valve 104 is deactivated and the first port 118 is connected to the second port 120. Similarly, activation of the 3-2 valve 104 fluidly connects the control chamber 176 with a return or drain pressure by fluidly connecting the first port 118 with the third port 122 of the 3-2 valve 104. In this embodiment, fuel drains from the control chamber 176 when the 3-2 valve 104 is activated.

During operation of the fuel injector 100, fuel at the supply pressure, for example, pressures of 190 MPa or higher, is passed into the needle chamber 142. When the 3-2 valve 104 is not active, the control chamber 176 is filled with fuel at the supply pressure, which is communicated to the control chamber 176 through the second orifice 180, the first orifice 184, and the clearance 182. While in this condition, the fuel injector 100 is not injecting fuel from the openings 140 because the needle 150 is urged to the seated or closed position. Compression of the spring 156 pushes the needle 150 toward the closed position, and hydraulic pressure applied by the fuel on both the valve seat portion 152 and the hydraulic closing surface 178 of the needle yields a biasing force to close the needle 150.

When the 3-2 valve is activated, and the first orifice 184 is connected to return pressure, the pressure within the control chamber 176 decreases to the return or to atmospheric pressure. This pressure-drop in the control chamber 176 removes a component of hydraulic pressure force acting on the closing hydraulic surface 178 reversing the force bias on the needle 150 from a closing bias to an opening bias. Thus, the needle 150 moves from its seat causing fuel at the supply pressure to exit the injector 100 through the openings 140. Therefore, unseating of the needle 150, sometimes referred to as an injection initiation event, occurs when the 3-2 valve 104 is activated.

The pressure in the control chamber 176 following initiation of the injection event is maintained below the supply pressure, even though fuel at the supply pressure may enter the control chamber 176 via the second orifice 180 and the clearance 182. Maintenance of the pressure in the control chamber 176 below the supply pressure is accomplished by appropriately sizing the first orifice 184 to provide a greater flow area than combined flow areas of the second orifice 180 and the clearance 182. For example, the ratio between the flow area of the first orifice 184 to the combined flow area of the second orifice 180 and the clearance 182 is greater than one and may be between about 1.01 and 1.50. It can be appreciated that the clearance 182 may provide a negligible contribution to the flow area of the second orifice 180. In such a case, the flow area of the clearance 182 may be considered zero or negligible compared to the flow areas of the first orifice 184 and the second orifice 180.

When termination of the injection event is desired, the 3-2 valve 104 is deactivated via electrical control signals de-energizing the solenoid. This, in turn, connects the first orifice 184 to supply pressure. With the first orifice 184 exposing the control chamber 176 to supply pressure, the pressure within the control chamber 176 increases and restores the hydraulic pressure force component acting on the closing hydraulic surface 178 to urge the needle 150 to its closed position. The relatively reduced flow areas of the orifices and clearance acting to fill the control chamber 176 contribute to a cushioning effect when closing the needle 150, thus avoiding abrupt seating or slamming of the needle 150 against the needle housing 236.

Figure 3:
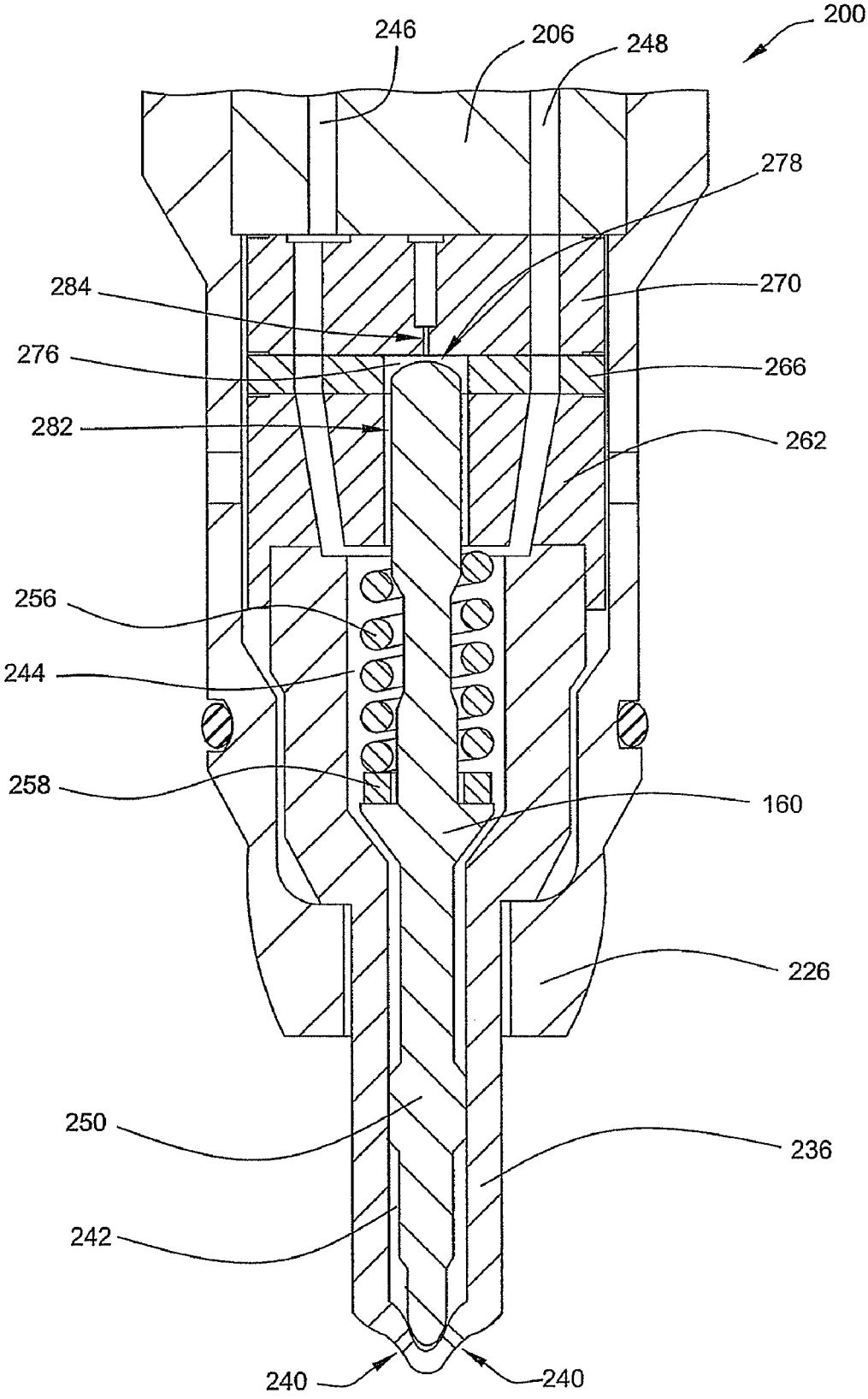
FIG. 3 is a cross section of a portion of a second embodiment of a fuel injector in accordance with the disclosure.

A detail cross section of a second embodiment of a fuel injector 200 is shown in FIG. 3. Same or similar elements between the first and second embodiments are denoted, relative to the second embodiment, by reference numerals having "2" as their first digit, with the last two digits being the same for each corresponding element for the sake of simplicity. In the second embodiment, a cone nut 226 encloses the needle housing 236, the needle 250, the guide block 262, a second plate 266, and a first plate 270. The needle housing 236 encloses a needle chamber 242 being in fluid communication with a supply pressure passage 246. The supply pressure passage is fluidly connected to a reservoir containing fuel at the supply pressure (not shown), and to the second port of a 3-2 valve (not shown) via a longitudinal supply pressure passage 248 extending through the extension portion 206. A spring 256 and backing ring 258 are located within a spring chamber 244 and impart a closing spring force onto a ledge 260 formed on the needle 250.

Operation of the injector 200 is similar to the operation of the injector described in connection with the first embodiment inasmuch as a control chamber 276 operates to bias forces in a closing direction across the needle 250 when the injector 200 is not undergoing an injection event. When injection is desired, a first orifice 284 is fluidly connected to a return or atmospheric pressure causing a pressure drop in the control chamber 276. The pressure drop alters the hydraulic pressure force bias acting on the needle 250 allowing the needle to move in an opening direction. Upon termination of the injection event, supply pressure is restored in the control chamber 276 operating to push the needle 250 in a closing direction.

A difference in structure between the injector 200 of the second embodiment and the injector 100 of the first embodiment is the absence of the second orifice, denoted by 180 in the first embodiment (see FIG. 1 and FIG. 2), from the first plate 270 of the second embodiment. The first plate 270 does not include an orifice fluidly connecting the control chamber 276 directly with a source of supply pressure. The first orifice 284 intermittently connects the control chamber 276 with supply pressure present in the needle chamber 242 through operation of the 3-2 valve. In the second embodiment, fluid connection of the control chamber 276 to supply pressure is accomplished through leakage of fuel into the control chamber 276 via the clearance 282 between the needle 250 and the guide block 262 and/or the spacer plate 266.

Figure 4:
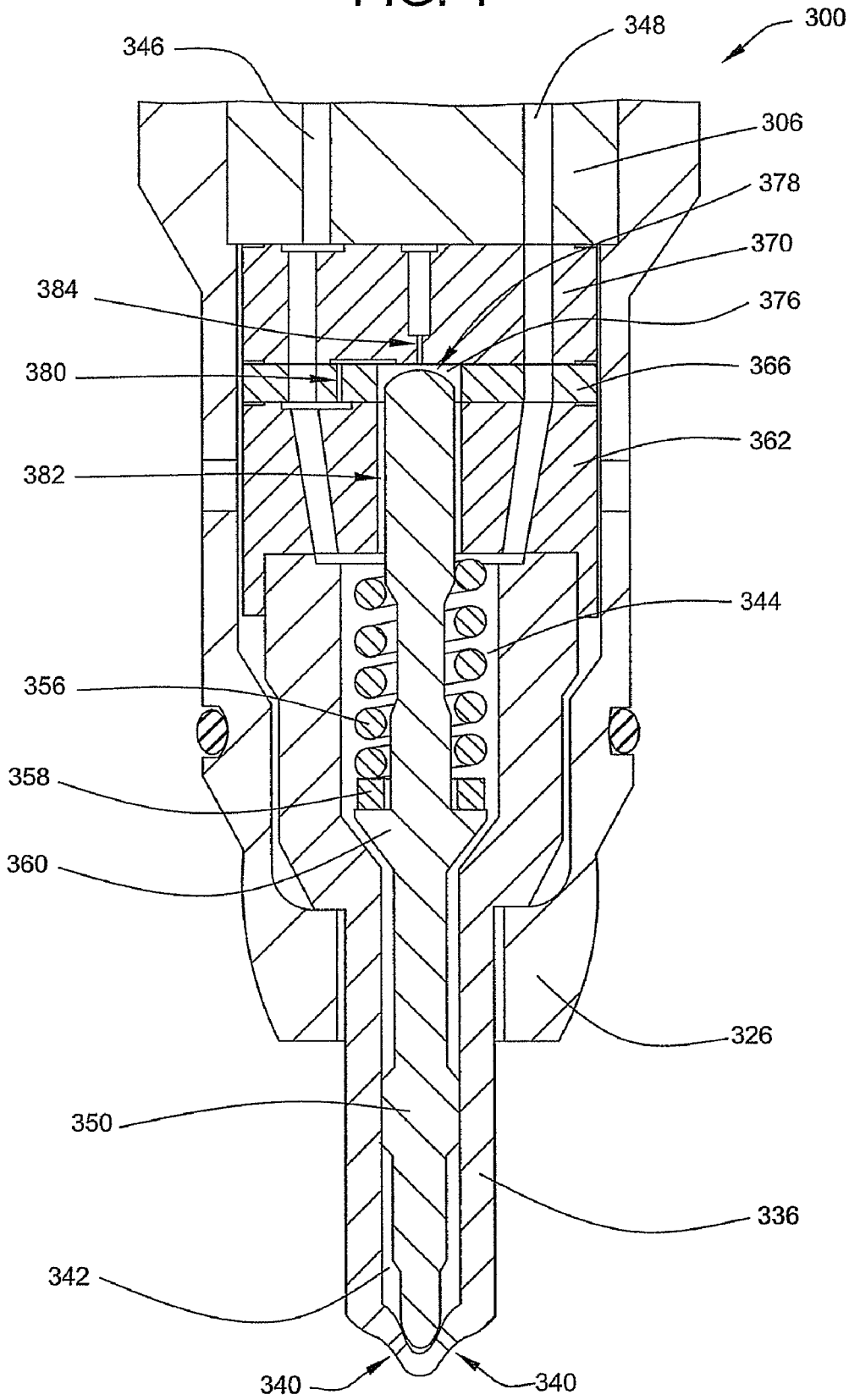
FIG. 4 is a cross section of a portion of a third embodiment of a fuel injector in accordance with the disclosure.

A detail cross section of a third embodiment of a fuel injector 300 is shown in FIG. 4. Same or similar elements between the first, second, and now third embodiments are denoted, relative to the third embodiment, by reference numerals having "3" as their first digit, with the last two digits being the same for each corresponding element for the sake of simplicity. In the third embodiment, the cone nut 326 encloses the needle housing 336, the needle 350, the guide block 362, a second plate 366, and a first plate 370. The needle housing 336 defines a needle chamber 342 being in fluid communication with a supply pressure passage 346 fluidly connected to a reservoir containing fuel at the supply pressure (not shown), and to the second port of a 3-2 valve (not shown) via a longitudinal supply pressure passage 348 extending through the extension portion 306, as described above. A spring 356 and backing ring 358 are located within a spring chamber 344 and impart a closing spring force onto a ledge 360 formed on the needle 350.

Operation of the injector 300 is similar to operation of the injectors 100 and 200 described in connection with, respectively, the first and second embodiments. A control chamber 376 operates to balance forces having a closing bias across the needle 350 when the injector 300 is not activated. When injection is desired, a control or first orifice 384 formed in the first plate 370 is fluidly connected to a low or return or drain pressure to effect a drop in pressure within the control chamber 376. The reduction in pressure within the control chamber 376 reverses the bias forces and allows movement of the needle 350 toward an opening direction. When termination of injection is desired, supply pressure is restored in the control chamber 376. The restored supply pressure acts to reverse the bias forces acting on the needle 350 such that the pressure in the control chamber 376 urges the closing hydraulic surface 378 of the needle 350 to a closed position.

One difference in structure between the injector 300 of the third embodiment and the injector of the first embodiment is that the second orifice 380, which is also known as the balance orifice, is formed in the second plate 366 instead of the first plate 370. The second orifice 380 fluidly connects the control chamber 376 to fuel at the supply pressure within the passage 346. The first plate 370 lacks an orifice fluidly connecting the control chamber 376 with the needle chamber 342. Instead, the first orifice 384 formed on the second plate 366 intermittently connects the control chamber 376 with supply pressure through the 3-2 valve (not shown here). As in the first embodiment, connection of the control chamber 376 with the needle chamber 342 is accomplished, in part, through leakage of fuel into the control chamber 376 via the clearance 382 between the needle 350 and the guide block 362 and, in part, through the second orifice 380. It can be appreciated that, in this embodiment, the flow area of the clearance 382, which is also sometimes referred to as the nozzle back leak, may be about zero or negligible. Negligible, as used here, may mean that the flow area of the clearance 380 is very small or less than about 15% compared to the flow area of the second orifice 380.

INDUSTRIAL APPLICABILITY

The present disclosure is applicable to fuel injectors for use with internal combustion engines. The fuel injectors disclosed herein include needle valves controlling the timing and rate of fuel injection into the engine. Motion and acceleration of the needle during injection initiation and termination events depends, at least in part, on the flow of fuel into and out from the control chamber during operation. This motion of fluid depends on the respective flow areas of the orifice(s) formed in the various plates and the clearance between the needle and guide connecting the control chamber with sources of fluid at the supply pressure and with various ports of the 3-2 valve. More specifically, fluid flow entering and exiting the control chamber in the three embodiments occurs through the second orifice 180 or 380, when present, the clearance 182, 282, or 382, and the first orifice 184, 284, and 384. Performance of the injector may depend on the ratio between the flow area of the first orifice to the sum of flow areas of the clearance between the needle and guide with the second orifice, when present. If this ratio is allowed to change as a result of dimensional tolerances found in typical manufacturing processes, variability in the performance of injectors can span almost 10% within a sample population or, alternatively, as much as 2 cubic millimeters of fuel per injection event at a supply pressure of about 190 MPa. Accordingly, closer dimensional control of certain dimensions extending beyond the typical capabilities of manufacturers are desired, but such tighter tolerances typically lead to increases in cost and scrap rates in the manufacturing process.

The manufacturing process for a fuel injector may advantageously be augmented to include one or more flow-rate tests of individual components making up each injector to determine their respective flow areas and classify each component in accordance therewith. The classified components may then be individually selected and combined or matched with other mating components. The resultant combination of components, when assembled together, will yield the desired flow area ratios in the finished injector assembly. Flow testing of injector components may be further facilitated by incorporating the various orifices and/or clearances in injector components having flat surfaces to enable sealing around each orifice while the flow testing is conducted.

Figure 5:
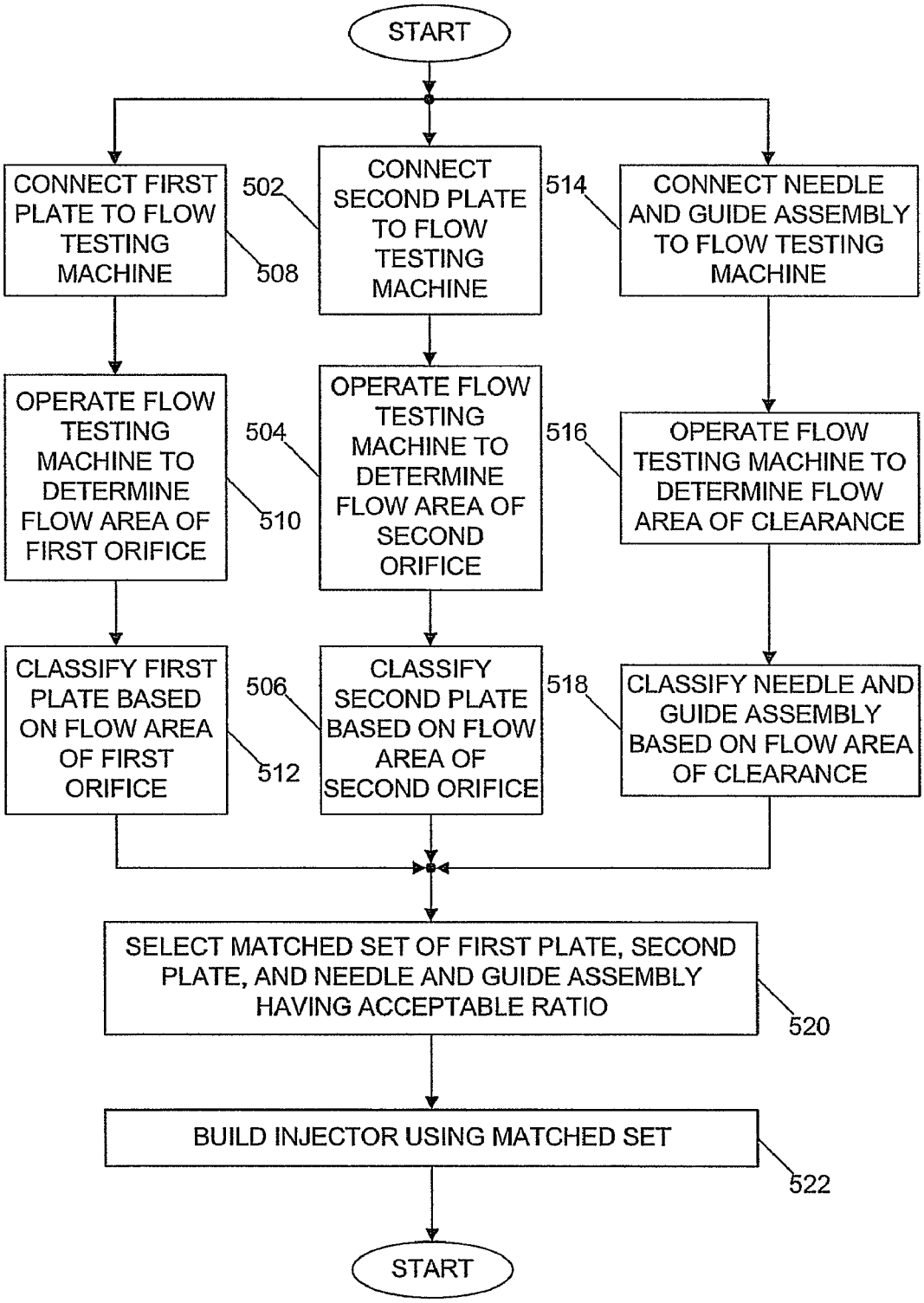
FIG. 5 is a flowchart for a method of assembling a fuel injector in accordance with the disclosure.

A flowchart for a method of assembling an injector having a known ratio of flow areas communicating with a control chamber of the injector is shown in FIG. 5. Even though the manufacturing process for a fuel injector includes numerous processes, the processes pertinent to the augmentation of a typical manufacturing process including flow testing of components are presented herein for simplicity. The method presented herein is described relative to the third embodiment for a fuel injector, for the sake of illustration by way of example, but one can appreciate the applicability of the method to injectors in accordance with the first and second embodiments or equivalents thereof.

A portion of the assembly process for a fuel injector includes manufacturing of a second plate having a second orifice formed therein, for example, the second plate 366 having the second orifice 380 formed therein. The second plate is connected, via an appropriate fixture, to a flow testing machine capable flowing a fluid through the orifice at a predetermined pressure to measure an equivalent flow area of the second orifice at 502. The flow tester is operated to determine the flow area of the second orifice at 504. Following the flow test, and depending on the measurement for the flow area of the flow orifice, the second plate may be classified at 506 based on the flow area of the second orifice.

In a similar fashion, a first plate having a first orifice formed therein, for example, the first plate 370 having the first orifice 384 formed therein as described relative to the third embodiment, may be manufactured. The first plate may be connected via a fixture to a flow testing machine at 508. The flow testing machine may operate to determine the flow area of the first orifice at 510 and classify the first plate based on the flow area of the first orifice at 512.

Similarly, a needle may be partially assembled into an opening formed in a guide block to yield a needle and guide assembly. The needle, for example, may be the needle 350 and the guide block may be the guide 362 described relative to the third embodiment. The needle and guide assembly may be appropriately mounted into a flow tester at 514 capable of generating a pressure difference across a clearance between the needle and guide opening such that an equivalent flow area therebetween may be calculated. The flow tester may operate to determine the equivalent flow are through the clearance at 516 and, based on the calculated flow area, classify the needle and guide assembly at 518. As can be appreciated, similar processes may be carried out for calculating flow areas in other components potentially affecting the performance of the injector. Similarly, fewer components may be tested as deemed appropriate.

After all required components have been flow tested and classified, sets of components may be selected to form sets or kits of components for assembly into a fuel injector at 520. Each matched set of components may be selected such that the ratio of the flow area of the first orifice, as measured in its respective flow test, is matched with the flow area or areas of the second orifice and/or the clearance area in the needle and guide assembly. Advantageously, by selecting components having been previously classified according to their respective flow areas, the matched sets of components selected can have a known and controlled ratio therebetween such that a desired flow area ratio may be selected. Each matched set is used for assembly of a fuel injector at 522, and the process is repeated. As can be appreciated, the various steps recited herein are exemplary and may be performed during more than one manufacturing stages. For example, each of the first and second plates may be flow tested at a supplier's facility for classification before they are shipped to the injector assembly plant. Moreover, the various classifications for each component or assembly may be conducted based on acceptable tolerances for the resulting ratio sought in the final injector assembly.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A fuel injector, comprising:

a housing;

a valve disposed in the housing and including a first port and a second port, the valve moveable between a first position, in which the first port is fluidly coupled to the second port, and a second position, in which the first port is fluidly blocked from the second port;

a needle housing disposed within the housing, the needle housing defining a needle chamber and a plurality of openings;

a fuel inlet port formed in the housing, the fuel inlet port in continuous fluid communication with the needle chamber;

a needle guide located in the housing and disposed to provide a guide opening;

a needle disposed in the needle chamber, the needle defining a guide portion and a seat portion, the guide portion disposed in the guide opening, the seat portion contacting the needle housing when the needle is in a closed position such that the plurality of openings are fluidly isolated from the needle chamber;

a first orifice defined in a first plate of the housing and being in fluid communication with the first port of the valve;

a second orifice formed in a second plate of the housing and disposed to fluidly couple the needle chamber to a control chamber, the second plate forming a bore at least partially defining the control chamber;

the needle having a closing hydraulic surface defined thereon, the closing hydraulic surface disposed in the control chamber;

wherein the control chamber is directly fluidly connected to the first orifice;

a clearance flow area fluidly connecting the needle chamber with the control chamber;

wherein a flow area of the first orifice is greater than the clearance flow area.

2. The fuel injector of claim 1, wherein the flow area of the first orifice is greater than a sum of the clearance flow area and a flow area of the second orifice.

3. The fuel injector of claim 1, wherein a ratio of the flow area of the first orifice to a sum of the clearance flow area and a flow area of the second orifice is between 1.01 and 1.50.

4. The fuel injector of claim 1, wherein the second port of the valve is fluidly coupled to a drain.

* * * * *